US005500639A

United States Patent [19]

Walley et al.

[11] Patent Number: 5,500,639

[45] Date of Patent: Mar. 19, 1996

[54] SATELLITE UNIT IDENTIFICATION SYSTEM

[75] Inventors: Ian M. Walley, Gloucester; Timothy R. F. Hankins, Herefordshire, both of England

[73] Assignee: Scantronic Limited, Greenford, England

[21] Appl. No.: 249,981

[22] Filed: May 27, 1994

[30] Foreign Application Priority Data

May 27, 1993 [EP] European Pat. Off. ..... 93304147

[51] Int. Cl.[6] ..... G08B 1/08

[52] U.S. Cl. ..... 340/539; 340/531; 340/555; 455/67.1; 359/145; 359/172

[58] Field of Search ..... 340/539, 505, 340/531, 825.69, 825.72, 825.06, 825.15, 825.54, 555, 556, 825.36; 455/53.1, 54.1, 67.1, 38.2; 359/109, 143, 145, 152, 154, 155, 159, 172, 167, 164

[56] References Cited

U.S. PATENT DOCUMENTS

| | | | |
|---|---|---|---|
| 3,513,443 | 5/1970 | Andersen . | |
| 4,020,477 | 4/1977 | Brunius | 340/539 |
| 4,622,540 | 11/1986 | Guscott et al. | 340/555 |
| 4,630,035 | 12/1986 | Stahl et al. | 340/531 |
| 4,692,742 | 9/1987 | Raizen et al. | 340/531 |
| 4,737,770 | 4/1988 | Brunius et al. | 340/539 |
| 4,855,713 | 8/1989 | Holland | 340/539 |

FOREIGN PATENT DOCUMENTS

| | | |
|---|---|---|
| 338765 | 10/1989 | European Pat. Off. . |
| 513443 | 11/1992 | European Pat. Off. . |

*Primary Examiner*—Donnie L. Crosland
*Attorney, Agent, or Firm*—Laubscher & Laubscher

[57] ABSTRACT

In a fire, smoke or intruder detection system including a master unit and satellite units with remote sensors, the satellite units send alarm transmissions to the master unit over a radio frequency channel. In order to register satellite units with the master unit each satellite unit is provided with a unique identification code and, after suitable triggering, sends a signal including this code to the master unit over a line-of-sight communications channel. The master unit registers satellite unit identification codes received on the line-of-sight channel and disregards radio frequency transmissions if they include unregistered satellite unit identification codes.

26 Claims, 3 Drawing Sheets

SATELLITE UNIT IDENTIFICATION SYSTEM

SPECIFICATION

STATEMENT OF THE INVENTION

The present invention relates to the field of alarm systems and, more particularly, to methods and apparatus by which satellite units such as sensor units in an alarm system identify themselves.

BRIEF DESCRIPTION OF THE PRIOR ART

In general, alarm systems consist of a control unit, a number of distributed sensors units, and one or more alarm output units. There may also be a hand-set for an operator to remotely control the control unit. In modern systems the alarm sensors are adapted to communicate with the control unit using signals at radio frequencies. Both simplex and duplex communication have been used for this purpose.

Typically a sensor will send a message to the control unit when an alarm condition has been detected, when the sensor is being subjected to tampering or when the sensor battery is running low.

Radio transmission from alarm sensors include a sensor identification code within the transmitted message. In this way the control unit can determine which sensor has detected the alarm condition, has a low battery, etc. In order to make the determination the control unit must be pre-programmed so as to learn the identification codes of the sensors in the system. Initially this was achieved by having the system installer set up codes in each sensor and corresponding codes in the control unit. This involved setting up matching dispositions of switches in the sensors and the control unit.

Increasingly there has been a trend away from manual intervention in the sensor registration process. As a first step, alarm systems were supplied in which each sensor had its identification code preset at the factory. However, the installer still needed to set up corresponding codes in the control unit. Next, it was proposed that each sensor identification code should be arranged to contain a portion common to the particular system, i.e. a "house code". In this arrangement the control unit would be set up to monitor sensor transmissions and to learn identification codes of sensors which had sent to the house code and which had not transmitted previously. Here the "house code" must be manually input in each sensor when it is installed.

A near-automatic system is described in the Holland U.S. Pat. No. 4855713. In that system each sensor has a pseudo-random identification code set at the factory when the sensor is manufactured. Instead of using a house code to identify sensors as belonging to a particular system the control unit is arranged to learn the identities of all the sensors which transmit to it while it is in a program mode. Thus as a preliminary stage when the system is installed it is necessary to put the control unit into program mode and then to trigger each sensor so that it makes one of its transmissions. In practice it is simplest to trigger a "tamper" transmission because the tamper detection device usually consists of a switch within the sensor housing and that switch can be manually operated.

Although the system of U.S. Pat. No. 4855713 has the advantage that it avoids much manual involvement in the identification process it does have a problem. If the alarm system in question is being installed in the vicinity of a neighbor's alarm system then there is a danger that a sensor from the neighboring system may inadvertently become registered at the control unit. This will occur when a sensor in the neighboring system happens to transmit during the time when the control unit is in program mode.

In the field of paging by radio communication it is known to send both optical and radio frequency signals from a central station. Such an arrangement is disclosed in European Patent Application EP-A-0338765, consisting of a transmission device comprising a modulation circuit, a radio signal transmitter for transmitting message signals through air after converting them into radio signals, and an optical signal radiator for radiating the message signals through air after converting them into optical signals. A reception device has a contrivance capable of receiving both the radio and optical signals, of combining these signals in order to reproduce the message signals, and of demodulating the message signals from the combined signals. In such an arrangement, the optical signals are used to carry the same information as the radio signals, and are transmitted at the same time, such that a receiver may receive the information from one or other signal, depending on the respective locations of the transmitter and the receiver. It is noted in the above-mentioned application that privacy of communication may be ensured by utilizing the optical transmitter, in order to prevent the signal from being received by devices of the communication systems, but the application does not concern the registration of systems units, and hence the particular use of the optical medium to which the present invention relates is not contemplated in any way in relation to the paging system described above.

Embodiments of the present invention have the advantage that they avoid the problem mentioned above, in relation to U.S. Pat. No. 4,855,713, of inadvertent registration of sensors foreign to the alarm system in question. They also retain the advantage of requiring minimal manual intervention in registering sensors onto the alarm system.

SUMMARY OF THE INVENTION

A primary object of the present invention is to provide a system comprising a master unit and at least one satellite unit, wherein:

at least one satellite unit comprises means for transmitting signals including a satellite unit identification signal over a radio frequency channel and means for transmitting signals including the satellite unit identification signal over a line-of-sight communication channel; and the master unit comprises means for receiving signals on radio frequency and line-of-sight communications channels, means for recovering satellite unit identification signals from the received signals and means for registering identification signals received on the line-of-sight channel as identification signals of satellite units belonging to the system. The present invention further provides a master unit for the above system and a method of registering a satellite unit as a member of a system such as the above system.

In general, alarm systems according to preferred embodiments of the invention have a plurality of satellite units, some or all of which are sensor units having sensors for sensing alarm conditions such as the presence of an intruder, fire or smoke. Such sensor units may also have sensors for sensing conditions such as low battery-power or tampering with the sensor unit. Other types of satellite units in the system, such as siren units, telecommunication units for alerting remote users or the emerging services, or keypads for entering data or instructions into the master unit, may all include sensors for sensing information such as battery strength, and communications means such as that described above for transmitting signals to the master unit. The term "satellite unit" will thus be used to refer to any units such as the above which may be registered as members of the system by the method of the present invention.

In preferred embodiments of the invention the second communications channel makes use of the L.E.D. which is provided on the housing of a conventional sensor unit. In particular, the satellite unit is designed or adapted so that, when suitably triggered, the L.E.D. will flash a series of pulses representing the satellite unit identification code. The control unit is provided with an "eye" for detecting the identification code pulses and with circuitry/software to demodulate the code information for recordal. This has the advantage of requiring only a few new elements in the satellite unit.

The present invention may be embodied in systems including an installer or operator's hand-set as well as in systems which only comprise a central unit and distributed sensors. The sensors may be intruder detectors, fire and smoke detectors or other devices. Each satellite unit is provided with a unique identification code, by a pseudo-random code generator selecting from a large range, by serially encoding each satellite unit, or otherwise.

As mentioned above, in preferred embodiments of the invention the satellite unit registration transmission is sent using the light emitting diode that conventionally is provided on the housing of a sensor unit. In conventional sensor units this LED is arranged to light up when the sensor unit is making a radio frequency transmission. In this way the owner of the system can see when a particular sensor unit is communicating with the control unit and has confidence in the system. The LED may be set up to illuminate when any or all of the possible radio frequency transmissions occur, e.g. "battery low", "tamper" or alarm condition transmissions.

In preferred embodiments of the invention the conventional sensor circuitry is modified so as to include a new switching arrangement controlling the illumination of the LED. This switching arrangement controls the on-off status of the LED so that a series of light pulses representing the satellite unit identification code are transmitted when the LED section is triggered. The LED section may be arranged to be triggered when the satellite unit makes radio frequency transmissions, as in conventional sensor units. Alternatively, or additionally, a special triggering button may be provided for manual operation by the installer or, in duplex systems, the LED section may be triggered by receipt of a special signal from the control unit or a hand-set.

The control unit according to preferred embodiments of the invention incorporates an optical detector in addition to the normal radio frequency section, microprocessor, display, keyboard and input/output circuitry. The optical detector may be a light sensitive diode and preferably is provided on a circuit board within the control unit so as to be accessible only to the installer. The output of the optical detector is thresholded, demodulated and fed to the control unit microprocessor. The microprocessor is adapted to detect the occurrence of a valid satellite unit identification code, for example by checking whether a received series of pulses corresponds to an identification code having an appropriate number of bits.

BRIEF DESCRIPTION OF THE DRAWINGS

The invention will now be described further by way of example, with reference to the figures, of which

DETAILED DESCRIPTION

Figure 1:
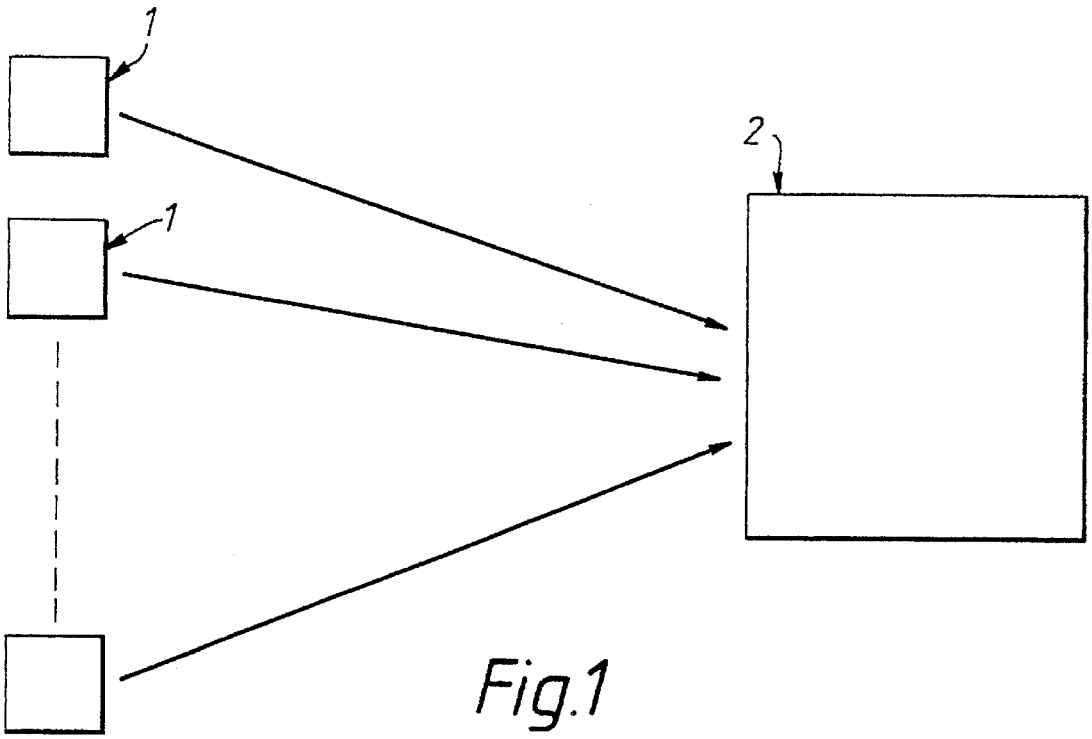
FIG. 1 shows an alarm system including a master unit and a plurality of satellite units.

Referring to FIG. 1, there is shown in diagrammatic form a plurality of satellite units 1, which in this example are sensor units for sensing alarm conditions, each communicating with a single master unit 2. In certain circumstances only a single satellite unit 1 need be used however. In general, a plurality of satellite units, an exemplary form of which is described in more detail in relation to FIG. 2, may be located at a number of places around a site to be monitored. A single master unit, an exemplary form of which is described in relation to FIG. 3, may be placed at a convenient location on or off the site.

Figure 2:
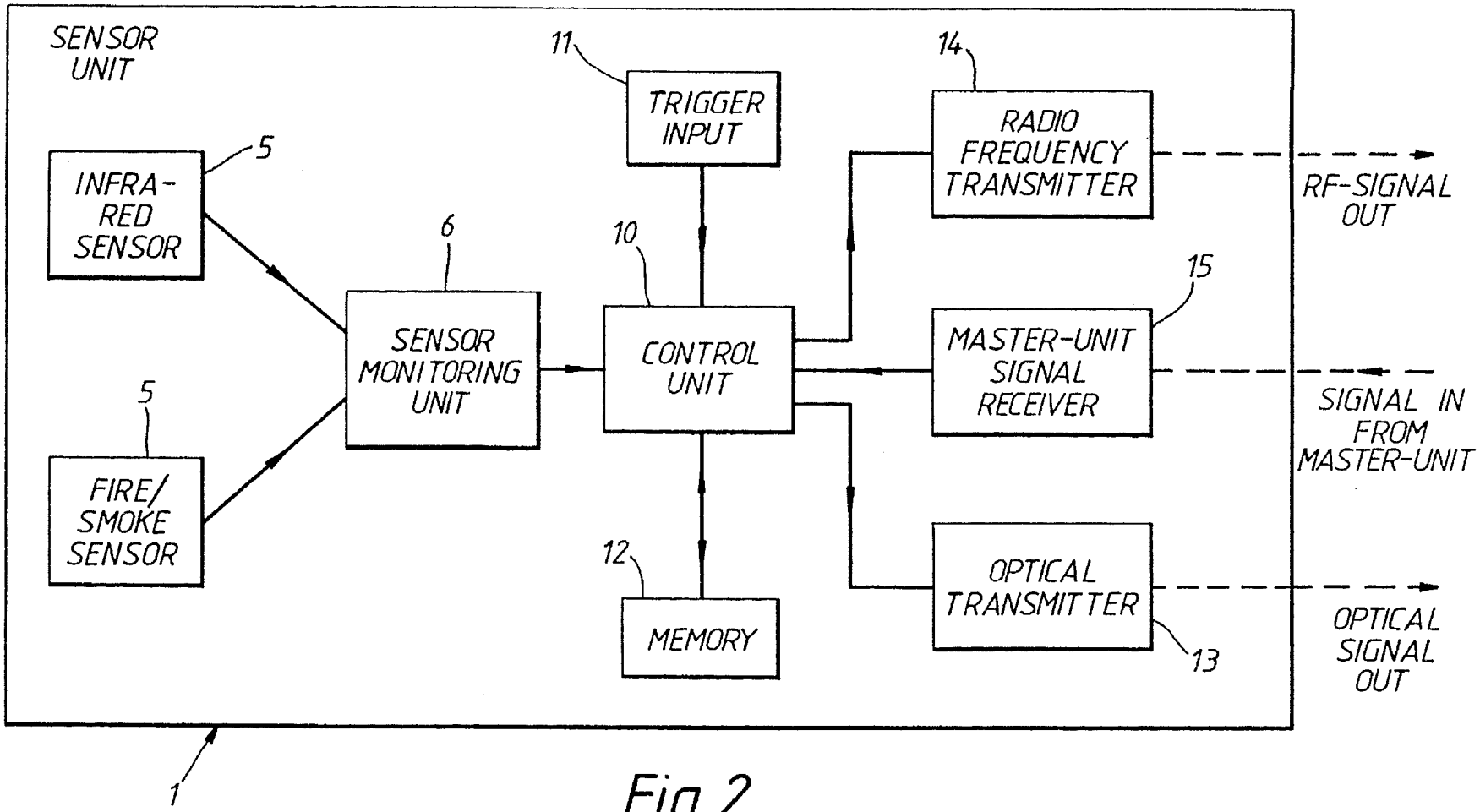
FIG. 2 shows an embodiment of a satellite unit for use according to the invention.

Referring now to FIG. 2, the satellite unit 1 which in this example is a sensor unit, has sensors 5 which may be, for example, an intruder sensor such as an infra-red sensor, and fire and/or smoke sensor. Each satellite unit 1 may have a single type of sensor, or a plurality of sensors. Signals from the or each sensor 5 are sent to sensor monitoring circuitry 6 which sends signals indicative of whether an alarm condition is detected to a control unit 10. When an alarm condition is detected, the control circuitry 10 causes a radio-frequency transmitter 14 to transmit a signal indicative of the detected alarm condition, and indicative also of the particular satellite unit 1 from which the signal is being transmitted. This is done by incorporating a unique identification code, stored in a memory unit 12, in the transmitted signal.

Figure 3:
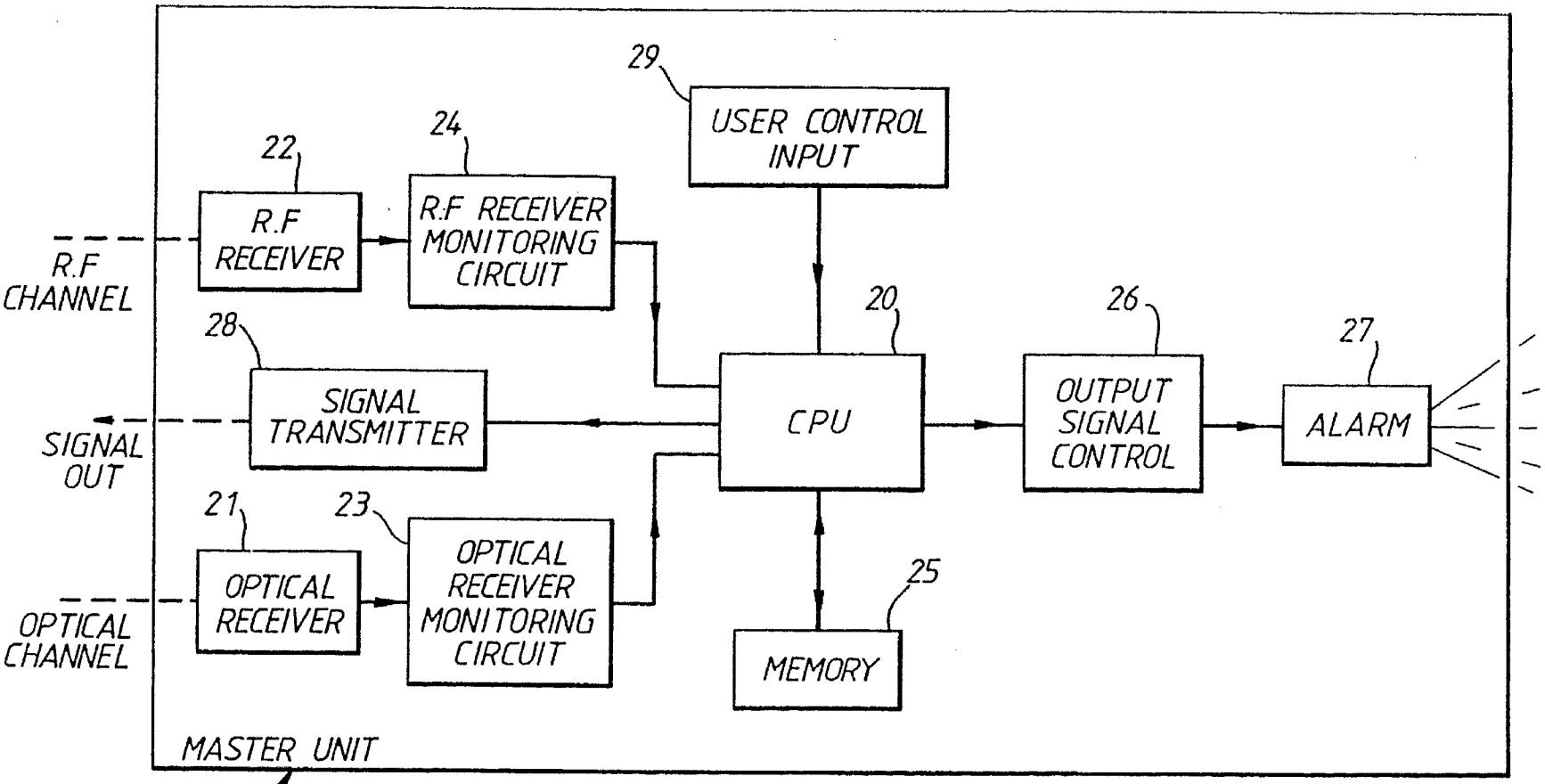
FIG. 3 shows an embodiment of a master unit for use according to the invention.

Referring now to FIG. 3 the master unit has a radio-frequency receiver 22 for receiving signals from the or each satellite unit 1. Any signals received are monitored by a monitoring unit 24 and sent to a central processing unit 20 (CPU). The CPU compares the identification code portion of the received signal with a stored list of the identification codes of satellite units in a memory unit 25, in order to determine firstly whether the satellite unit from which the signal has been received is within the relevant alarm system, and secondly in order to determine which satellite unit has sent the signal. If the signal is indicative of an alarm condition detected by a satellite unit of the correct alarm system, the CPU may instruct an output control unit 26 to cause an alarm unit 27 to produce a sound or light signal, or to produce a telecommunications signal to a remote location.

The present invention is concerned with the manner in which the master unit registers the identification codes of the or each satellite unit.

According to a preferred embodiment of the invention, at least one satellite unit 1 has an optical transmitter 13 such as a light emitting diode (LED) to which the control unit 10 sends signals when triggered suitably. Triggering may be caused by means of a dedicated trigger unit 11 and causes the control unit 10 to send a signal, including a portion containing the unique identification code of the particular satellite unit 1, to the optical transmitter 13. The portion containing the identification code is used to modulate an illumination signal to the LED, thus causing the optical transmitter 13 to emit a series of light pulses indicative of the satellite unit identification code, when the optical transmitter 13 is triggered.

The master unit 2 is provided with an optical receiver 21, including for example a photodiode. In order for the master unit to register the identification code of a satellite unit 1, the satellite unit is positioned such that the optical signals transmitted by the satellite unit are received by the optical receiver. The master unit 2 is placed in a "LEARN" mode by actuating a user control input unit 29. The satellite unit 1 is then triggered to cause it to emit the optical signal indicative of the identification code, which is received by the optical receiver 21. An optical receiver monitoring unit 23 monitors the received signal and demodulates it in order to obtain the code information which is passed to the CPU 20. If necessary, the monitoring unit 23 may be provided with filters and other processing circuitry in order to remove any contributions to the received signal due to, for example, electric lighting. If a valid code is detected, the CPU 20 registers that code in the memory unit 25 as the code of a satellite unit in its system.

The above steps are repeated for each satellite unit 1 in the system, each unit having a unique identification code, the codes being stored in the memory unit 25. When the identification codes of all the satellite units have been registered, the master unit 2 is released from its "LEARN" mode by means of the user control unit 29, and the satellite units may then be installed in their required locations.

Figure 4:
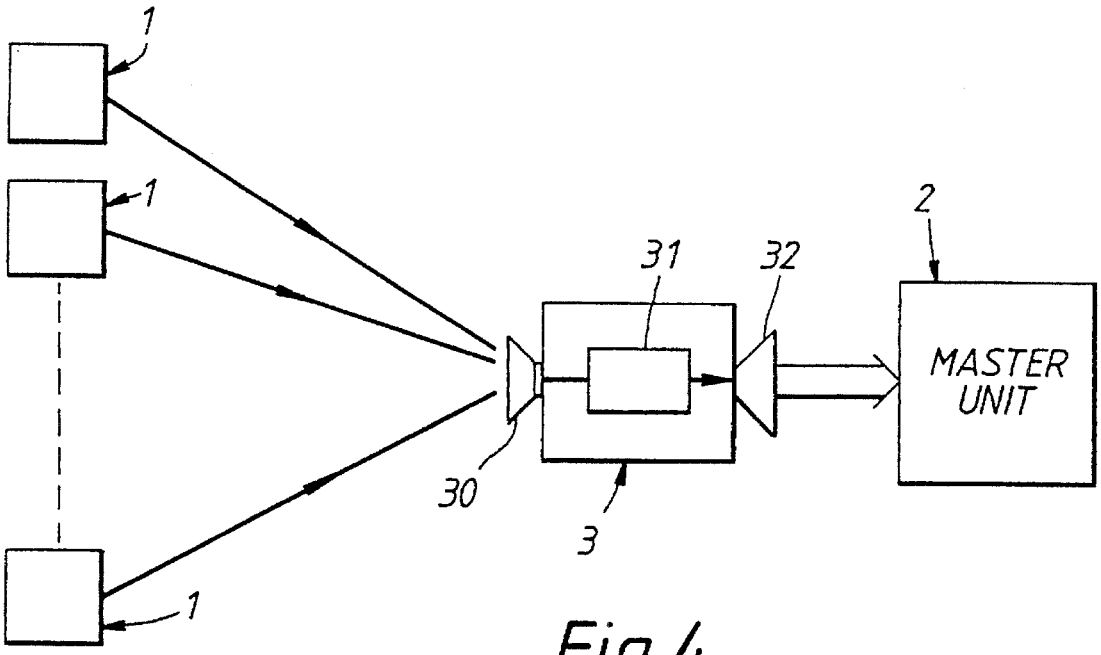
FIG. 4 shows an alarm system including a master unit, a plurality of satellite units and a portable intermediate signal transfer unit.

The master unit 2 shown in FIG. 3 includes an optional signal transmitter unit 28 which may be activated by signals from the CPU 20 if it is required to have a duplex system. In this case, the satellite unit 1 includes an optional master-unit signal receiver 15, shown in FIG. 2. With the duplex system, the transmitter 28 may be caused by the CPU 20 to send out a trigger signal to the satellite unit whose identification code is being "learned", thus removing the need for the trigger input unit 11 in each satellite unit 1. Alternatively the transmitter 28 may be used to send out "TEST" signals to the satellite units, in order to determine whether or not they are functioning correctly, or whether their power supplies are low. The manner in which this is done will not be explained in detail, but it should be noted that signals sent by the transmitter 18 may carry identification codes indicative of the satellite units for which they are intended, or of the master unit itself in order to prevent the satellite units from responding to "TEST" signals from the master units of neighboring systems, provided the satellite units are provided with suitable circuitry to recognize and respond to the identification codes transmitted to them. Referring now to FIG. 4 an alternative manner of registering the identification codes of satellite units in a system will be described. According to the system of identification code registration shown diagrammatically in FIG. 4, the satellite units 1 and the master unit 2 are essentially the same as those used in the system of FIG. 1. There is, however, an intermediate stage in the registration of codes, involving an additional component which will be referred to as the intermediate signal transfer unit 3. The intermediate signal transfer unit 3 is a portable unit which includes an optical receiver 30 which may be similar to the optical receiver 21 in the master unit 2, and also includes an optical transmitter 32 which may be similar to the optical transmitter 13 in the satellite units 1. Between the receiver 30 and transmitter 32 is suitable circuitry 31 to detect an optical signal, store data indicative of the detected optical signal, and regenerate the optical signal after a period of storage, the signal being transmitted by the optical transmitter 32.

The system shown in FIG. 4 allows the master unit 2 to register the identification codes of the satellite units 1 after said satellite units have been installed in their respective locations around the site to be monitored. Instead of bringing each satellite unit 1 to a position within view of the master unit 2, the intermediate signal transfer unit 3 is taken to each satellite unit 1 in turn, and the satellite unit is triggered to produce an optical signal, either by means of a trigger input unit 11 such as that shown in FIG. 2, or otherwise. The satellite unit then produces the optical signal including a portion indicative of the unique identification code of that satellite unit, which is received, processed and stored by the intermediate signal transfer unit 3. The optical signals from one or more satellite units 1 can be stored in this way. The intermediate signal transfer unit 3 is then taken to a position such that optical signals from its optical transmitter 32 are visible to the optical signal receiver 21 of the master unit 2. The identification codes stored in the intermediate signal storage unit 3 are then "downloaded" to the master unit 2 by activating the optical transmitter 32 such that the signals detected from the satellite units, or signals indicative of these signals are regenerated and can be received by the optical receiver of the master unit for processing by the CPU 20 and storage in the memory 25 as was described in relation to FIG. 3.

A major advantage of any of the optical systems described above is that only units within optical range, e.g. 6 inches, can become registered onto the system. Other types of short-range or low power transmissions which do not penetrate walls and the like can alternatively be used, for example, infrared and ultraviolet transmissions and ultrasonic and magnetic methods. These types of transmissions are generally referred to as being transmitted on "line-of-sight" channels, the important characteristic of such channels being that signals from transmitters outside a given range or outside a building or site to be monitored can be prevented from being received by the master unit on such channels. The expression "line-of-sight" should thus not be taken to include only visible or optical manners or communication.

We claim:

1. A method for registering a satellite unit as a member of an alarm system having a master unit, said satellite unit including means for storing a satellite unit identification signal; means for transmitting signals over a radio frequency communication channel, said signals having a portion indicative of said satellite unit identification signal; means for transmitting signals over a line-of-sight communication channel, said signals having a portion indicative of said satellite unit identification signal; and means for triggering the satellite unit to transmit a signal over said line-of-sight communication channel, and said master unit including, means for receiving signals on a radio frequency communication channel; means for receiving signals on a line-of-sight communication channel; and means for recovering and registering satellite unit identification signals received in signals on the line-of-sight communication channel, comprising:

(a) arranging the satellite unit such that signals transmitted over the line-of-sight communication channel of the satellite unit are transmitted such as to be received on the line-of-sight communication channel of the master unit;

(b) triggering the satellite unit to transmit a signal having a portion indicative of the satellite unit identification signal over the line-of-sight communication channel; and (c) recovering and registering in the master unit the satellite unit identification signal from the received signal.

2. The method of claim 1, wherein the line-of-sight channels are optical channels.

3. The method of claim 2, wherein the satellite unit further comprises a light emitting diode, means for triggering illumination of the light emitting diode and means for modulating the illumination of the diode by the satellite unit identification signal; and wherein the master unit further comprises means for demodulating identification signals from light pulses received on the optical channel.

4. The method of claim 1, wherein the system is a duplex system, and further comprising the step of transmitting a signal from the master unit for triggering a transmission from the satellite unit on its line-of-sight channel.

5. The method of claim 1, wherein the system is a duplex system, and the master unit has means for storing a master unit identification signal;

the satellite unit further comprises means for receiving transmissions from the master unit and for recovering and registering the received master unit identification signal; said method further comprising the step of triggering the master unit to transmit a signal including the master unit identification signal thereof, whereby the satellite unit recovers and registers the received master unit identification signal.

6. The method of claim 5, wherein the master unit transmits the master unit identification signal on its line-of-sight channel.

7. The method of claim 1, wherein the satellite unit is adapted to detect a predetermined condition and on the detection of the condition to transmit an alarm signal on the radio frequency channel.

8. A method for registering a satellite unit as a member of an alarm system including a master unit and a movable transceiver unit said satellite unit including means for storing a satellite unit identification signal; means for transmitting signals over a radio frequency communication channel, said signals having a portion indicative of said satellite unit identification signal; means for transmitting signals over a line-of-sight communication channel, said signals having a portion indicative of said satellite unit identification signal; and means for triggering the satellite unit to transmit a signal over said line-of-sight communication channel; said moveable transceiver unit including means for receiving communications on a line-of-sight communication channel; means for storing received communications; and means for triggering said transceiver to retransmit said stored communications on a line-of-sight communication channel; said master unit including means for receiving signals on a radio frequency communication channel; means for receiving signals on a line-of-sight communication channel; and means for recovering and registering identification signals received in signals on the line-of-sight communication channel; comprising:

(a) positioning the moveable transceiver such that signals transmitted over the line-of-sight communication channel of the satellite unit are received and stored by the moveable transceiver;

(b) triggering said satellite unit to transmit a signal having a portion indicative of said satellite unit identification signal;

(c) re-positioning the movable transceiver such that signals transmitted by said transceiver are received on the line-of-sight communication channel of the master unit;

(d) triggering the movable transceiver to transmit said stored signal; and (e) recovering and registering in said master unit the satellite unit identification signal.

9. A system for registering at least one satellite unit as a member of an alarm system including a master unit, comprising:

(a) means included in said satellite unit for transmitting a satellite unit identification signal over a radio frequency channel;

(b) means for transmitting signals including the satellite unit identification signal over a line-of-sight communication channel;

means included in said master unit for receiving signals on radio frequency and line-of-sight communications channels;

(d) means for recovering satellite unit identification signals from the received signals; and (e) means for registering identification signals received on the line-of-sight channel, when in a satellite unit registration mode, as identification signals of satellite units belonging to the system.

10. The system of claim 9, further comprising a movable transceiver having means for receiving communications transmitted over the line-of-sight communication channel by a satellite unit, and means for retransmitting communications indicative of those received over a further line-of-sight communication channel such that they are received on the line-of-sight communications channel of the master unit.

11. The system of claim 9, wherein the line-of-sight communications channels are optical channels.

12. The system of claim 9, wherein the satellite unit line-of-sight channel transmission means comprises a light emitting diode, means for triggering illumination of the light emitting diode and means for modulating light pulses from the diode by the satellite unit identification signal.

13. The system of claim 9, wherein the system is a duplex system and said master unit has means for transmitting, in use, a signal to trigger a transmission from the or each satellite unit on its line-of-sight communications channel.

14. The system of claim 9, wherein the system is a duplex system and said master unit has means when triggered, to transmit a signal including a master unit identification signal and the or each satellite unit comprises means for receiving the transmission from the master unit, and means for recovering and registering the received master unit identification signal.

15. The system of claim 14, wherein the master unit is adapted to transmit the master unit identification signal over its line-of-sight communications channel.

16. The system of claim 9, wherein the or each satellite unit is adapted to detect a predetermined condition and on the occurrence of the condition to transmit on alarm signal on the radio frequency communications channel.

17. The system of claim 9, further comprising means for comparing recovered satellite unit identification signals with said registered identification signals; and means to switch the master unit between a first mode wherein said means for recovering satellite unit identification signals received on said optical channel supplies said identification signals to said means for registering identification signals, and wherein said means for registering identification signals registers said identification signals as signals of satellite units belonging to the system, and a second mode wherein said means for recovering satellite unit identification signals received on said radio frequency channel supplies said identification signals to said comparing means, wherein said comparing means determines whether said identification signal are identification signals of satellite units within the system.

18. The system of claim 9, wherein the identification signal of the or each satellite unit is uniquely determined.

19. The system of claim 9, wherein the identification signal of the or each satellite unit is a pseudo-random identification signal.

20. The system of claim 9, wherein one or more of the satellite units further comprises a passive infrared sensor adapted to trigger an alarm transmission on the radio frequency channel when a moving infrared source is detected.

21. The system of claim 9, wherein one or more of the satellite units further comprises a fire or smoke detecting element adapted to trigger an alarm transmission on the radio frequency channel when fire or smoke is detected.

22. A master unit for a system including the master unit and at least one satellite unit, the master unit comprising:

(a) means for receiving communications on a radio frequency channel;

(b) means for receiving communications on a line-of-sight communications channel;

(c) first means for recovering and registering satellite unit identification signals from communications received on the line-of-sight communications channel; and (d) second means for recovering satellite unit identification signals from communications received on the radio frequency channel and for comparing the recovered identification signals with the registered identification signals, thereby to enable received communications to be disregarded if transmitted by unregistered satellite units.

23. The master unit of claim 22, wherein the line-of-sight channels are optical channels.

24. The master unit of claim 22, further comprising means for transmitting a signal to trigger a satellite unit transmission on its line-of-sight communications channel.

25. The master unit of claim 22, further comprising means for transmitting a signal including a portion indicative of a master unit identification signal assigned to the master unit.

26. The master unit of claim 22, further comprising means for switching the master unit between a first mode wherein said means for receiving transmissions on a line-of-sight channel supplies signals to said first means for recovering and registering satellite unit identification signals, and a second mode wherein said means for receiving transmissions on the radio frequency channel supplies signals to said second means; wherein communications from unregistered satellite units are disregarded.

* * * * *